US007325254B1

(12) United States Patent
Edgar et al.

(10) Patent No.: US 7,325,254 B1
(45) Date of Patent: Feb. 5, 2008

(54) CROSS-OVER

(75) Inventors: Danario Juanrico Edgar, Houston, TX (US); Kecia Lameta Pough, Houston, TX (US)

(73) Assignee: Danario Edgar, Houston, TX (US)

( * ) Notice: Subject to any disclaimer, the term of this patent is extended or adjusted under 35 U.S.C. 154(b) by 0 days.

(21) Appl. No.: 11/601,865

(22) Filed: Nov. 20, 2006

(51) Int. Cl.
*A41D 13/00* (2006.01)

(52) U.S. Cl. ..... 2/69; 2/102; 2/462

(58) Field of Classification Search ..... 2/69, 2/102, 462

See application file for complete search history.

(56) References Cited

U.S. PATENT DOCUMENTS 4,625,334 A * 12/1986 Proffer ..... 2/1
5,361,412 A * 11/1994 Perry ..... 2/69
6,350,168 B1 * 2/2002 Kroll et al. ..... 441/111
7,147,590 B2 * 12/2006 Toven ..... 482/51

* cited by examiner

*Primary Examiner*—Gary L. Welch
*Assistant Examiner*—Alissa J Tompkins

(57) ABSTRACT

The "Cross-Over" vest is made of a hybrid material with a Neoprene (polychlorine) base. The "Cross-Over" has six velcro straps that make for a snug fit on the torso. The velcro straps are located on the left and right shoulders, and two straps on the left torso and two straps on the right torso. In the straight front of the vest is an arm sleeve. There are two bungee cords, one for the left and right arm. The cords attach to the vest in the front bottom by two D-Rings. They also attach to the back bottom by two D-rings. The other end of each cords are attached to two elbow straps via a D-ring each. One for the left arm and one for the right arm.

3 Claims, 11 Drawing Sheets

Vest
Front View

Vest
Front View

Vest
Back View

Vest
Front Side View

Vest
Back Side View

Vest Assembly
Front View

Vest Assembly
Back View

Arm Sleeve Assembly
Front View
Right Left Arm Optional

A Typical Arm Sleeve
With Velcro Release Straps

A typical Restrainer Cord
With Hook and Adjustable Collar
Right Left Optional

A Typical Elbow Strap
With D-Ring
Right Left Optional

A Typical D-Ring and
Leather D-Ring Holder

CROSS-OVER

BACKGROUND OF THE INVENTION

The "Cross-Over" is derived from years of observing the manner in which children and athletes have a tendency to use one dominant side of their body, arm or hand when playing sports. Unable to use both sides of their body with equal dexterity and effectiveness, they never attain to their full potential. While coaches and trainers alike have devised numerous drills to help with ambidexterity, never has there been a lightweight device, which a person could use his or her own to the use of the particular side of the body, arms, and or hand. Furthermore, I noticed the absence of any device which would limit the movement of arms while dribbling a basketball, thereby restraining the body and limbs in an effort at keeping the basketball low and close to the body while dribbling for proper form and movement. Finally, it became evident that the market produced no such device that addressed the foregoing matters while simultaneously providing some form of resistance training. The "Cross-Over" was developed to address all of the foregoing needs via a portable and lightweight device that limits and restrains one or both arms or hands during the practicing of basketball basics (e.g. dribbling, moving, passing, and shooting). The "Cross-Over" is a training device that can be used privately and without the costly expense of hiring trainers and coaches. The foregoing briefly reflects the background and history of the "Cross-Over".

BRIEF SUMMARY OF INVENTION

The "Cross-Over" is a portable and lightweight basketball training vest for use by people of all ages and skill levels. The "Cross-Over" has different work-out areas. The first work-out area is called the "Arm-Sleeve". Its purpose is to help a person develop ambidexterity. The "Arm-Sleeve" is located in the front center of the vest. The "Arm-Sleeve" being a piece of material within which either the left or right arm is horizontally inserted and there after covered by two velcro straps. The "Arm-Sleeve" restrains a particular arm, thereby forcing the wearer to use the opposite arm during the course of dribbling, moving, passing, and shooting. The "Arm-Sleeve" portion of the "Cross-Over" allows a person to target their specific work-out to the weaker side of the body. This allows the dominant arm not to be an option while being held in place via the "Arm-Sleeve". Steady use and training with the "Arm-Sleeve" aspect of the "Cross-Over" is designed to build equal dexterity and effectiveness with both sides of the body, the arms, and both hands leading to an overall increase of balance, coordination, and skills.

The second work-out area of the "Cross-Over" vest is a unique cord restrainer system. These cords are comprised of latex rubber with a Polyprophylene cover. One end of the cord attaches to either the front or back of the training vest (depending on the particular exercise being performed) and the opposite end attached to an elbow strap made of poly rubber. Two cords are provided with the "Cross-Over". Naturally one being for the left arm and one being for the right arm. The two cords are removable. The wearer can use one cord and leave the other cord off. The wearer can also use both cords for either front or back depending on exercise. While the restrainer cords are worn, the wearer is able to perform difficult drills with his or her hands being in the right place everytime. It will correct bad form and it will make the wearer more agile in movement as well as with the basketball. The latex rubber base cords also provide consistent resistance, thereby building strength and control. The "Cross-Over" also works in unison with the "Arm-Sleeve" and restrainer cords. This allows the wearer to either dribble or pass with an arm in the "Arm-Sleeve" and the other is being restrained by the cords. Once a player uses the "Cross-Over" he or she will be a more complete and a more effective player by reaching their total potential of their body.

BRIEF DESCRIPTION OF THE SEVERAL VIEWS OF THE DRAWING

1.

PARTS OF THE "CROSS-OVER" VEST

Figure 1:
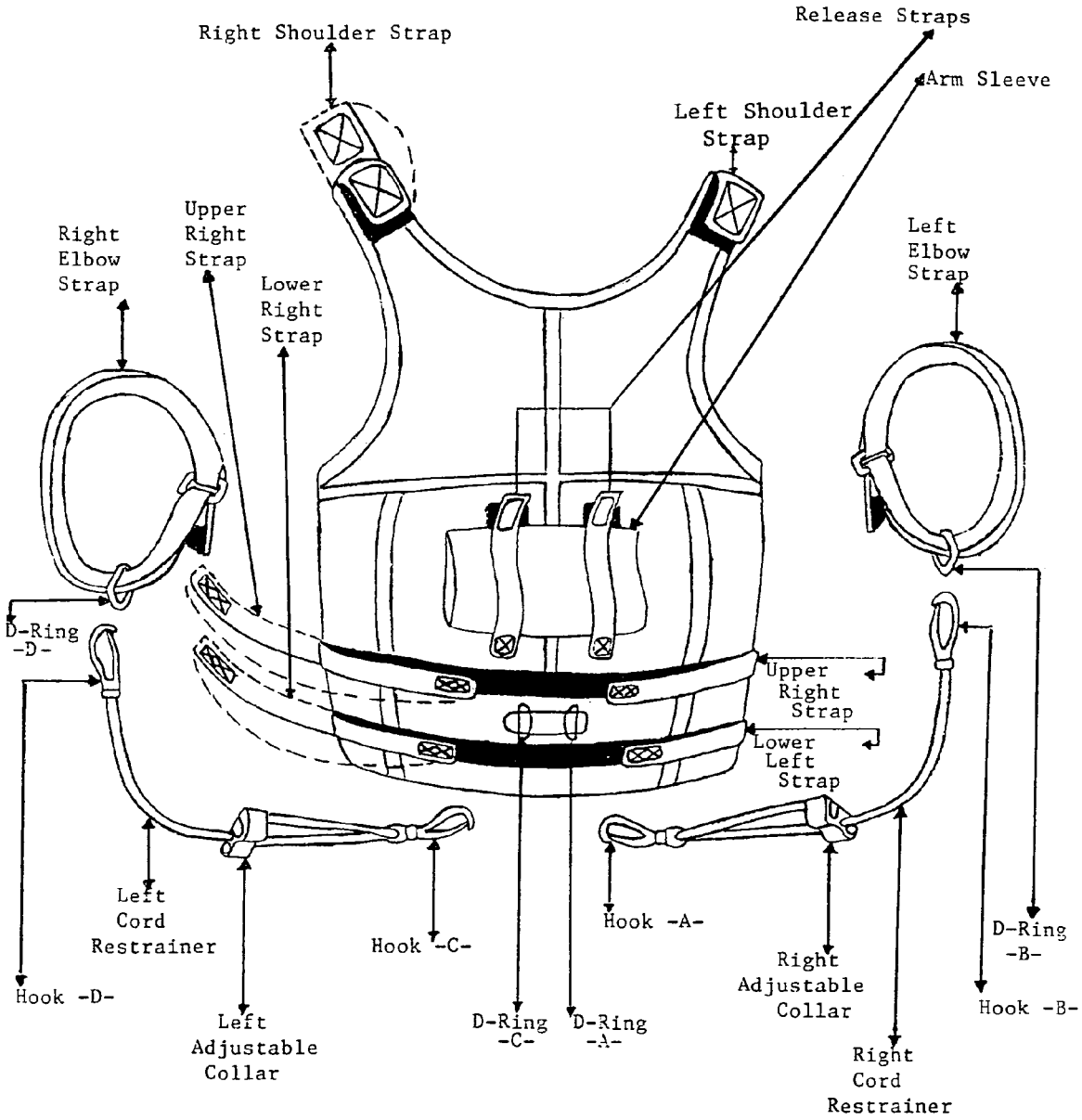
FIG. 1 shows each individual part for the front of the "Cross-Over" vest.
2.

1. Right Shoulder strap, Left shoulder strap
2. Right Elbow strap, Left Elbow strap
3. Upper right strap for torso, Upper Left strap for torso
4. Lower right strap for torso, Lower left strap for torso
5. D-Rings (6 D-Rings at 1 inch a piece required).
6. 1 Left and 1 Right restrainer cords required.
7. 1 Left and 1 Right adjustable collars.
8. 4 hooks
9. 1 "Arm-Sleeve" (20 inches in diameter).
10. 2 velcro straps to go over the "Arm-Sleeve".
11. 2-16 inches in diameter leather D-Ring mounts.

The "Cross-Over" vest is a portable lightweight basketball training vest. The primary function of the vest will be to train male and female athletes in the proper techniques of basketball dribbling, shooting, and passing skills. The "Cross-Over" vest has two unique work-out areas that have been specifically designed and incorporated together to help the wearer become a more complete basketball player.

The "Cross-Over" vest is fully illustrated to show each of its specific features in FIG. 1 (attachment). The "Arm-Sleeve" illustrated in FIG. 7 (attachment) and the cord restrainer system illustrated in FIG. 5 and FIG. 6 (attachment) are the areas the wearer will use in conjunction or as individual devices to help make the athlete into a more all around and complete basketball player.

Figure 2:
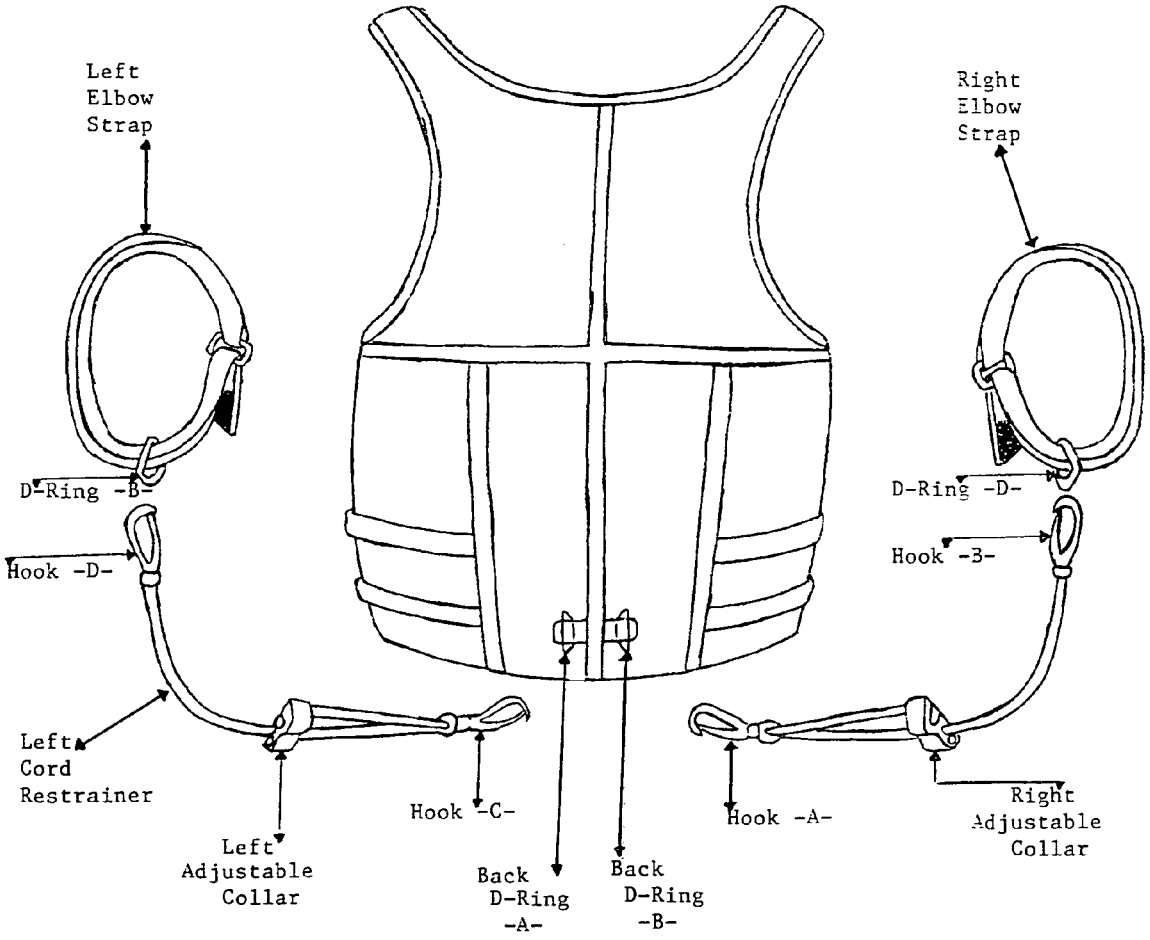
FIG. 2 shows each individual part for the back of the "Cross-Over" vest.
3.

The front of the "Cross-Over" vest is illustrated in FIG. 1 (attachment) and the back of the vest is illustrated in FIG. 2 (attachment). These two illustrations show the core features of the "Cross-Over" vest.

The main body of the "Cross-Over" vest will be comprised of an extremely versatile hybrid blend of synthetic rubber known as Neoprene (Polychlorine). This highly accessible hybrid material has numerous functional qualities over a basic blend of plain synthetic rubber. The hybrid blend material provides a thermal barrier that allows the skin to breathe. The material consists of a double knit outer and inner layer. The outer layer allows the skin to be ventilated to the atmosphere while the inner layer provides a lining material of soft towelling against the skin. In combination these two layers provide the athlete a comfortable fit for the best and ample ventilation during the work-out or training process.

Figure 3:
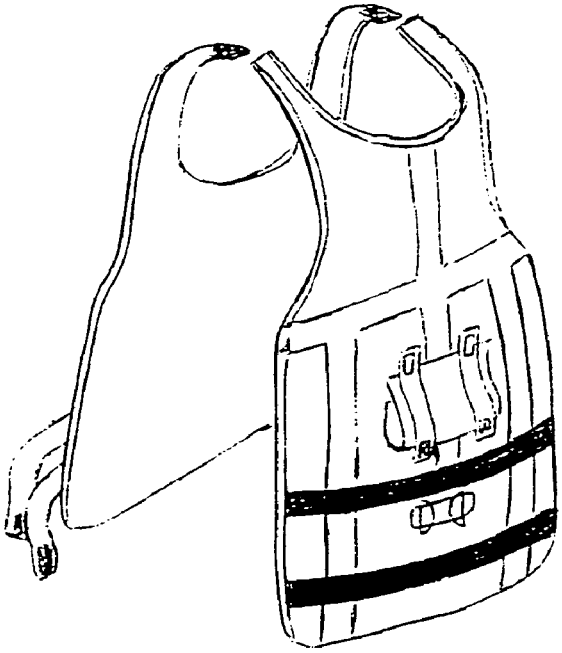
FIG. 3 shows the front side view of the "Cross-Over" vest.
4.
Figure 4:
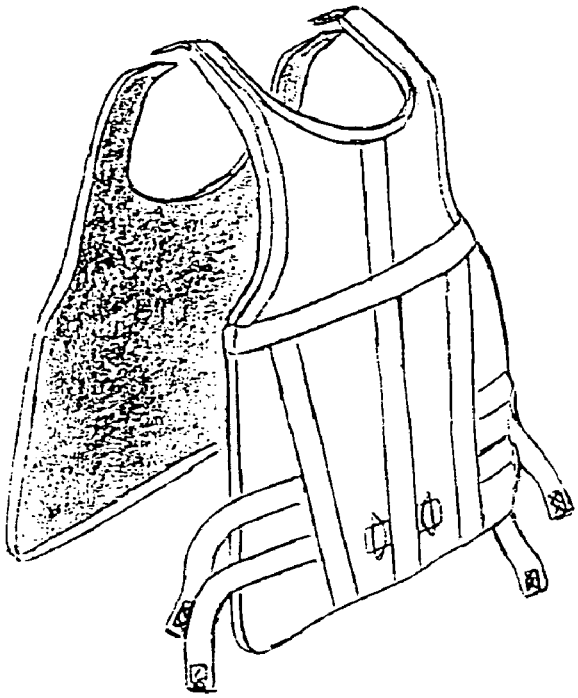
FIG. 4 shows the back side view of the "Cross-Over" vest.
5.

The hybrid material with Neoprene (Polychlorine) as its base is ideal for close contour fitting body apparel where body movement should not be hindered. The material is suitable for use in multi-layered clothing systems where the emphasis is on being lightweight. The "Cross-Over" vest (COV), is constructed in two separate components that are independent of one another as illustrated in FIG. 3 and FIG. 4 (attachment). The front and back vest components are designed to fit around the upper body and connect together to form a complete vest. The front and back components are connected by using velcro straps, one for the right shoulder and one for the left shoulder. The sides of the front and back components are secured together and adjusted properly by a pair of velcro straps on the right and left of the torso. The (COV) can be adjusted for comfort by adjusting the right and left shoulder straps or the right and left side torso straps. When the (COV) is being worn properly by the individual there should be no hindrance of movement on behalf of the individual to prevent them from bending over, running picking up objects, or obstructing any other movement.

Figure 7:
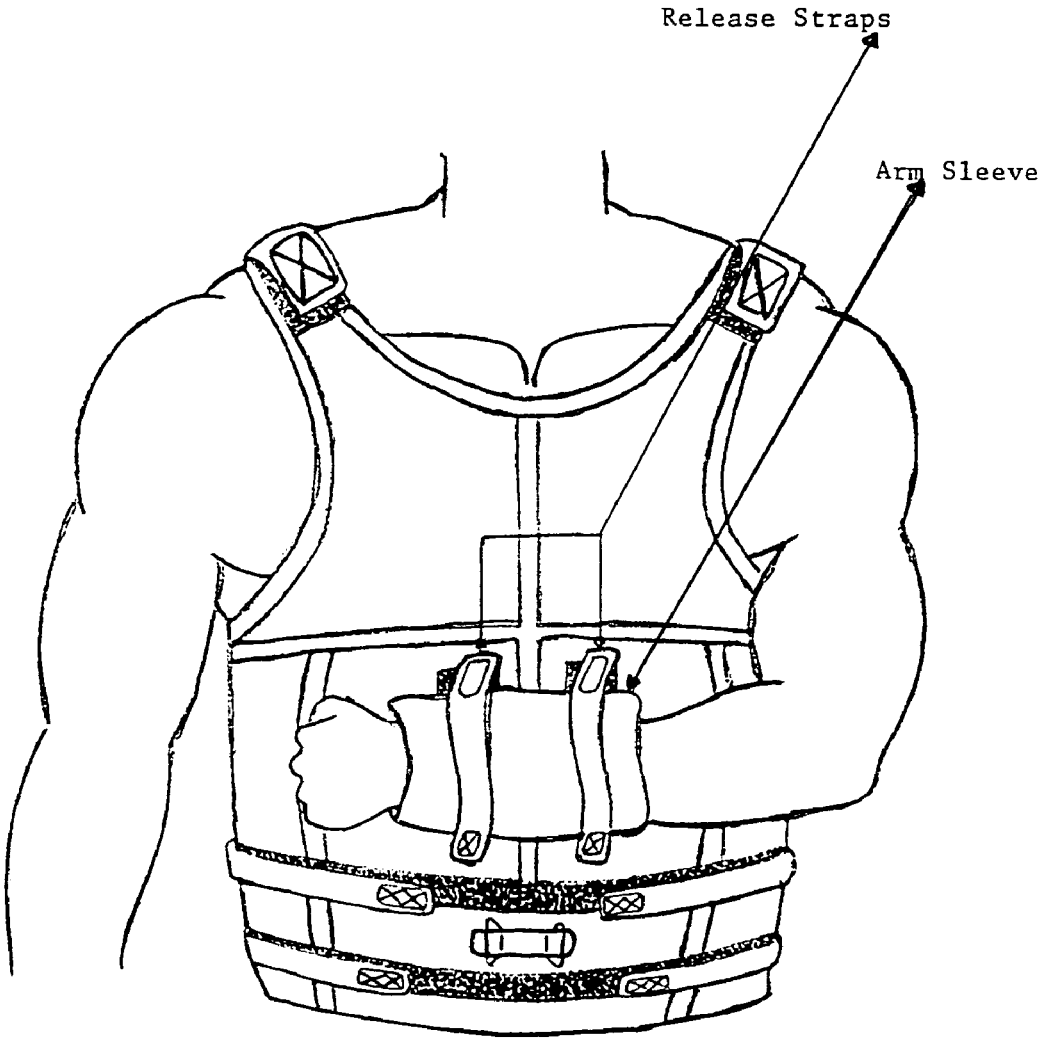
FIG. 7 shows the front of the "Cross-Over" vest with a particular arm properly placed in the "Arm-Sleeve" (Right or Left arm optional).
8.
Figure 8:
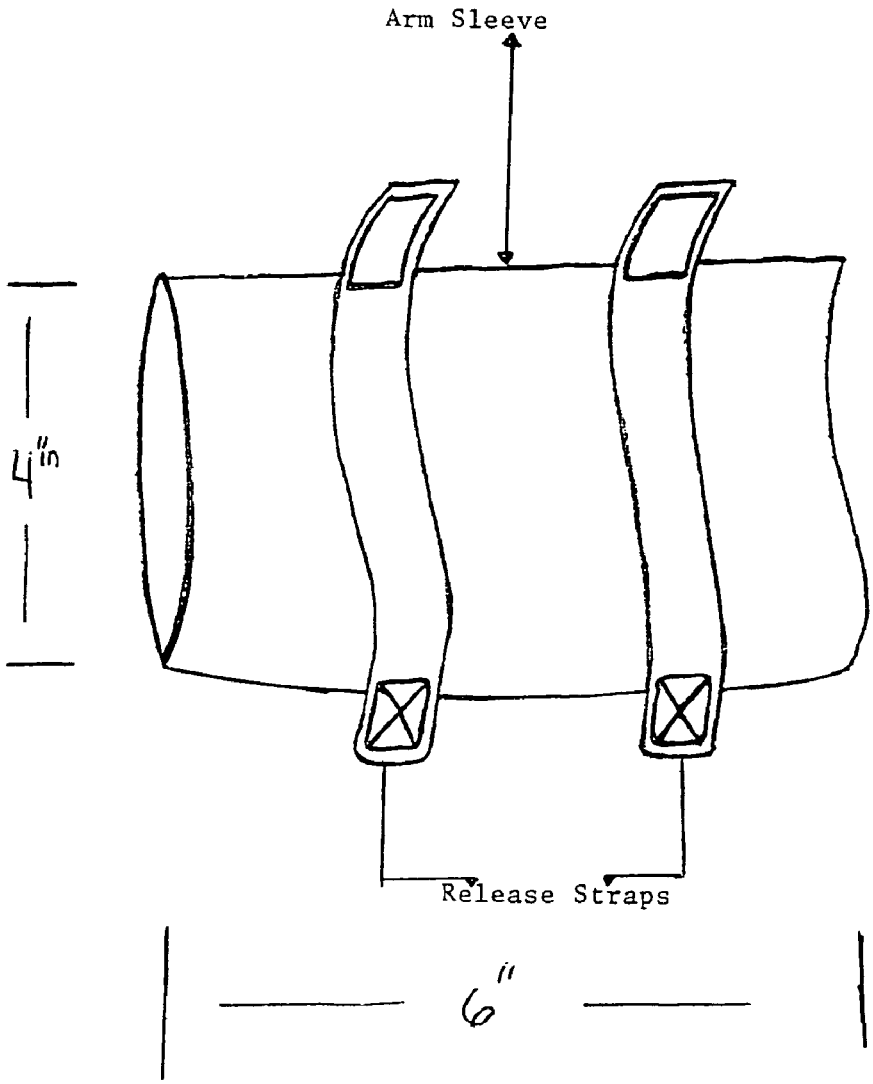
FIG. 8 shows A typical "Arm-Sleeve" with Velcro release straps.
9.

The "Arm-Sleeve" (AS), will be attached to the front of the (COV) as illustrated in FIG. 1, FIG. 7, and FIG. 8 (attachment). The (AS) will be made of the same hybrid Neoprene (Polychlorine) material that the (COV) is made of. It will be 20 inches in total diameter. The (AS) is stitched directly in the front center of the (COV) as illustrated in FIG. 7 (attachment). The (AS) will have two entries one for the left arm and one for the right. It is also accompanied by two velcro straps to keep the arm from moving once it is inserted FIGS. 7 and 8 (attachment). To utilize the (AS), the individual places their right or left arm into the sleeve. Once the desired arm is inserted the two velcro straps provided are then secured to hold the arm in place. While utilizing the (AS) during a work out; the individual will be forced to use their weaker side to perform dribbling, passing, and shooting or moving skills. The purpose of the (AS) is to help the individual athlete build their strengths on their weaker side. By developing the individuals weaker side it will balance their overall dexterity and make them a more complete and well-rounded player.

Figure 5:
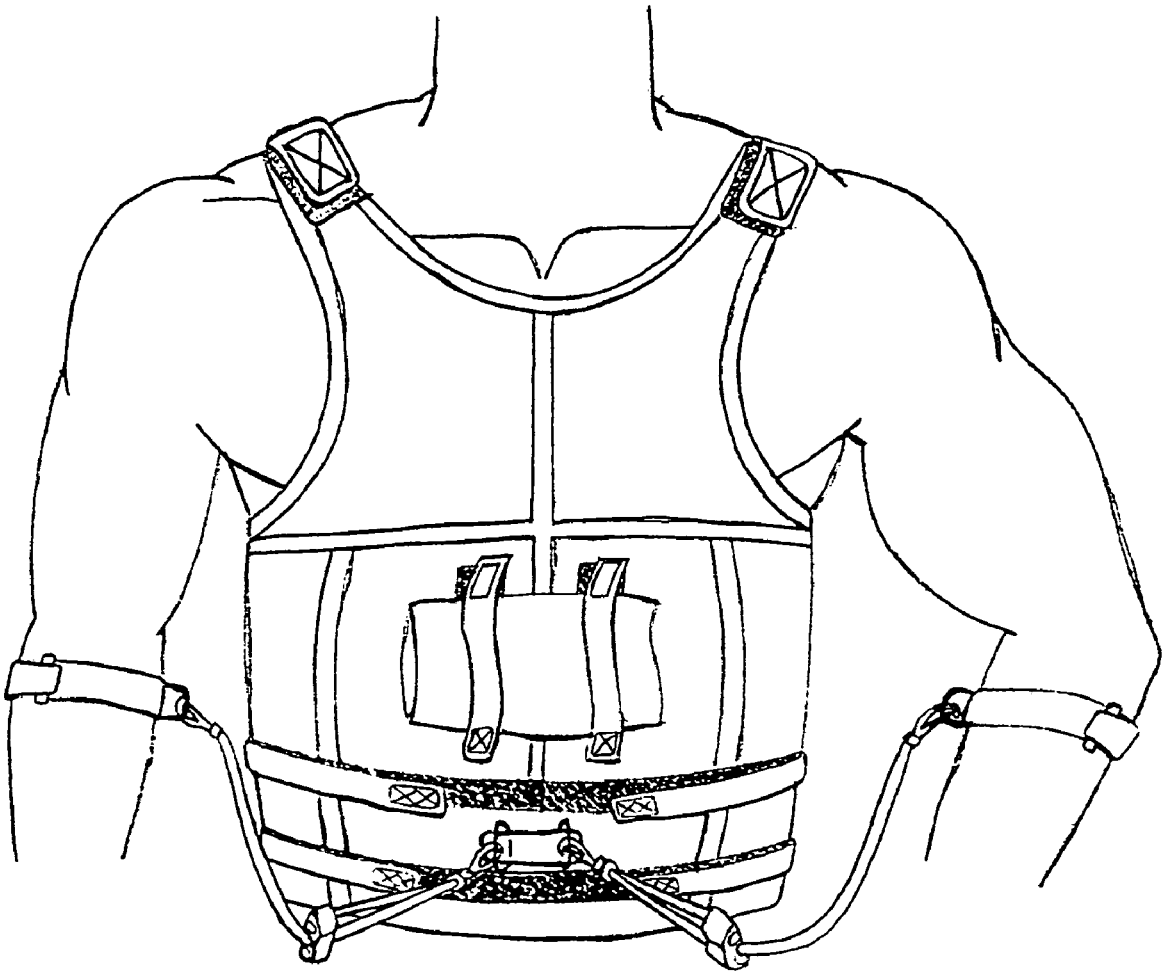
FIG. 5 shows the front of the "Cross-Over" vest fully assembled on an individual.
6.
Figure 6:
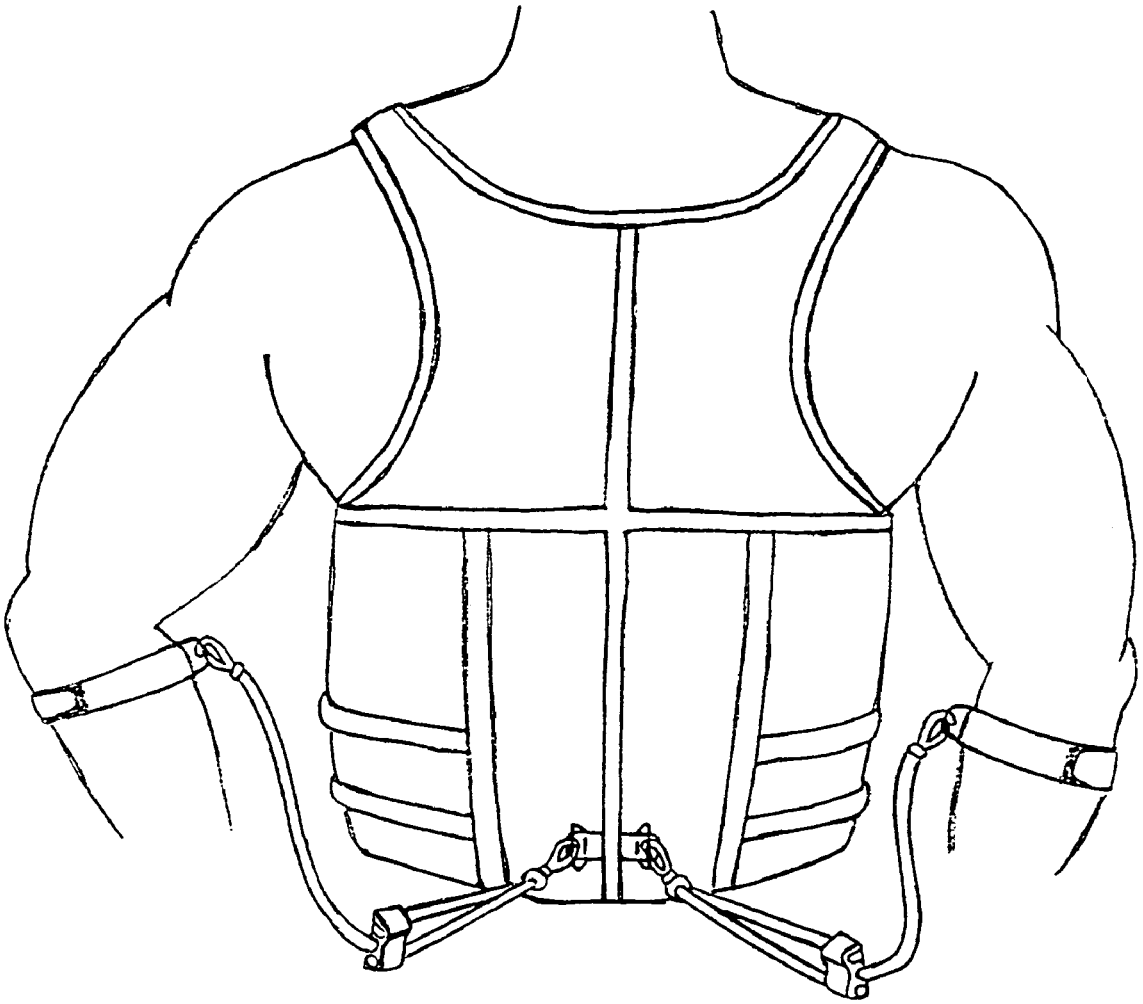
FIG. 6 shows the back of the "Cross-Over" vest fully assembled on an individual.
7.
Figure 9:
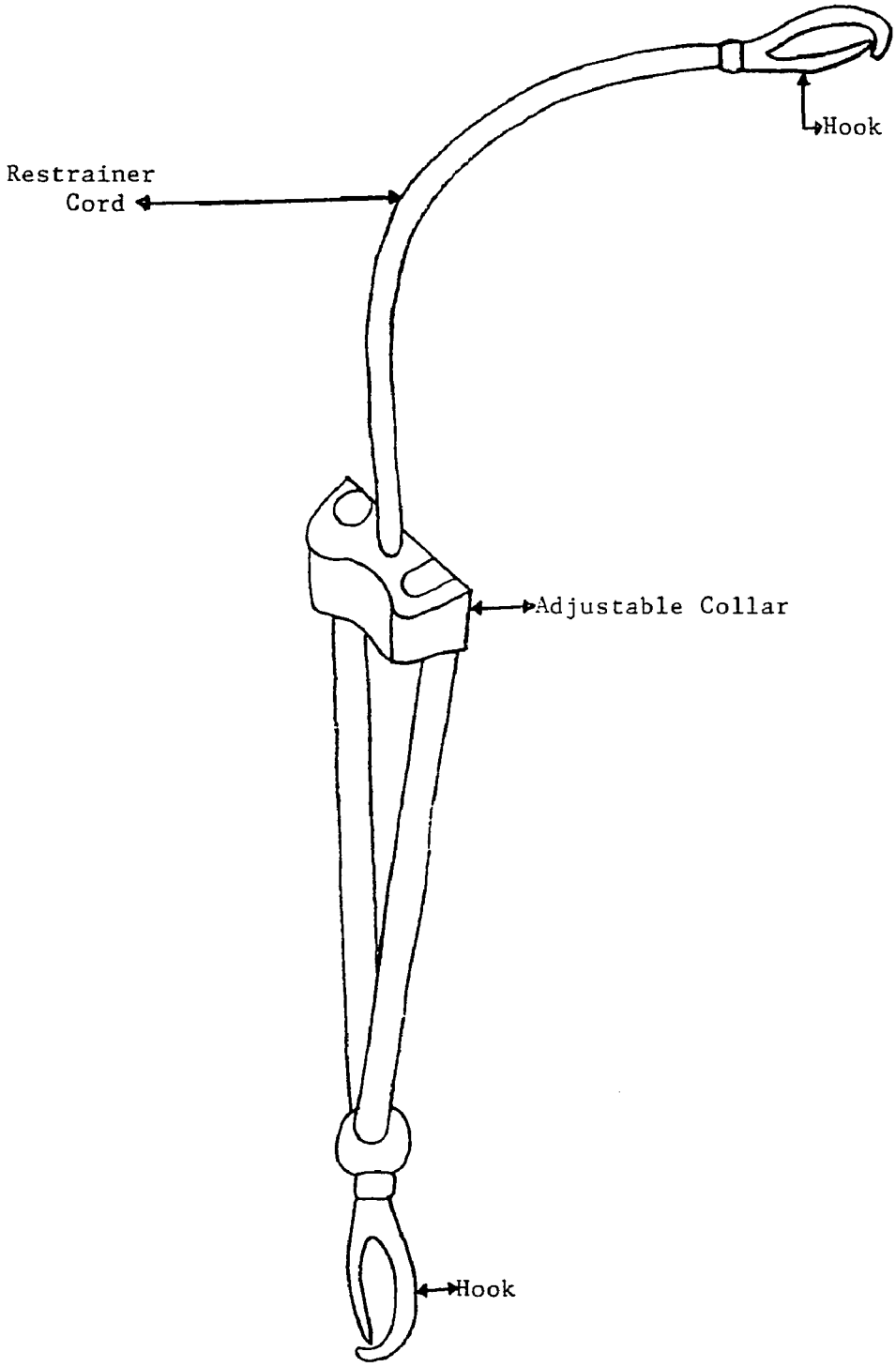
FIG. 9 shows A typical "Restrainer-Cord" with hooks and Adjustable Collar. (Right or Left cord optional).
10.

The "Cord Restrainers" (CR) are the second specifically designed component of the (COV). The (CR) are illustrated in FIG. 5 and FIG. 9 (attachment). Cord restrainers also know as bungee cords will be made of stretchy, flexible rubber core. Two cords will be supplied with the (COV), each covered with a polypropylene cover, resistive to salt water and UV light. Each cord is 40 inches in length and are equipped with an adjustable collar to help prevent snapback. The adjustable collar is made of high grade plastic that slides easily along the bungee cords and then secures in place with a simple tug. There is a locking hook on each end of the (CR) as illustrated in FIG. 9 (attachment). Each of the hooks are composed of glass reinforced hard nylon.

Figure 11:
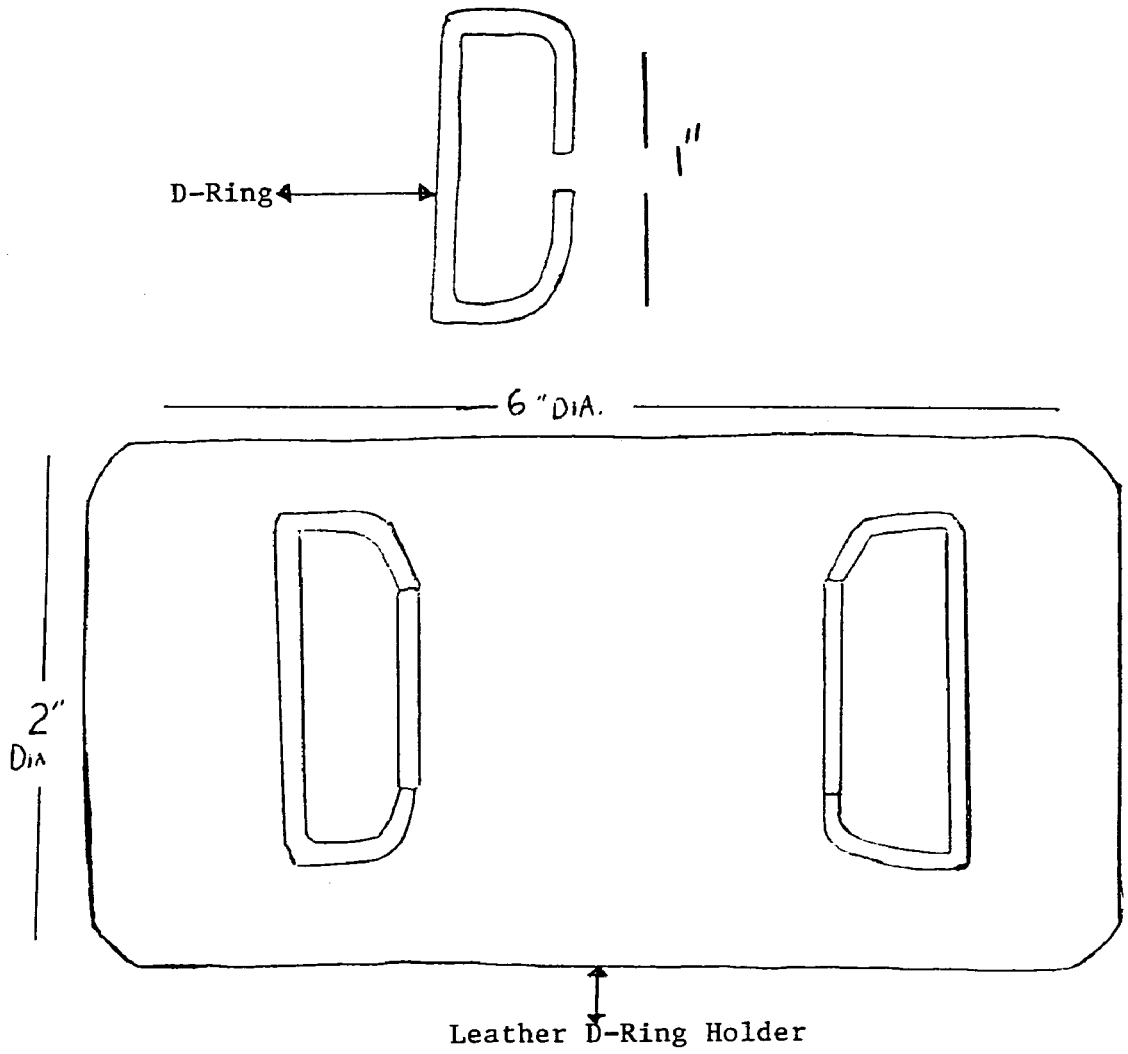
FIG. 11 shows A typical D-Ring and leather D-Ring mount. (Leather-D-Ring mount is 16 inches in diameter).

D-Rings are located on both the front and back of the (COV) as illustrated in FIG. 1 and FIG. 2 (attachment) The D-Rings are made of hardened stainless steel material and designed for medium levels of stress. The D-Rings are attached to the front and back of the (COV) by separate pieces of stitched 16 inches in diameter leather material. The D-Rings and the stitched leather mount are illustrated in FIG. 1, FIG. 2, and FIG. 11 (attachment). The D-Rings are sown into the reinforced stitched leather mounting pad and strategically located on the front and back of the (COV) for maximum training restriction.

Figure 10:
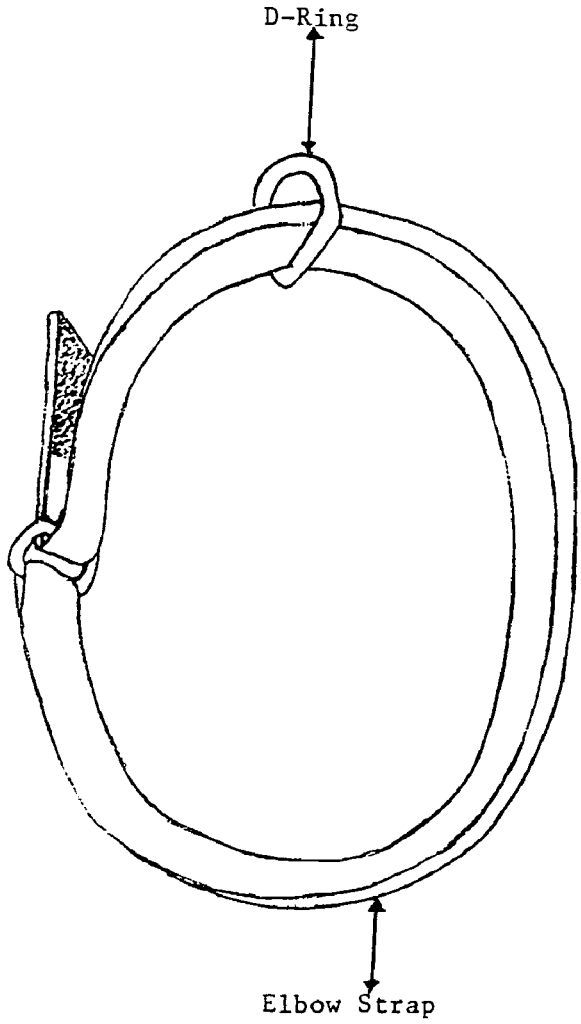
FIG. 10 shows A typical Elbow Strap with D-ring. (Right or Left optional).
11.

Elbow Straps (ES) are illustrated in FIG. 1, FIG. 2, and FIG. 10 (attachment). the (ES) are two inches wide and are designed to be a one size fits all. The (ES) are made of adjustable poly-rubber material. Each (ES) has a stainless D-Ring that slides easily over the length of the (ES) material. The hook and loop enclosures of the (ES) are designed for maximum-strength and comfort. The (CR) are designed to attach to the D-Rings (either in the front or the back of the (COV)) and to the D-Ring of the (ES). Once the (CR) safety hooks are attached to the D-Rings the individual can then adjust the length of the (CR) to meet their specific training needs. The foregoing reflects the detailed description of the "Cross-Over" vest.

The invention claimed is:

1. A torso conforming harness configured as a vest having a pair of torso sections for covering a user's torso area and a pair of shoulders for each torso section comprising:

a front torso panel having left and right shoulder portions each having a releasable fastener at an end thereof;

a back torso panel having left and right shoulder portions each having a releasable fastener at an end thereof wherein said front and back torso sections attach to each other by way of the releasable fasteners;

said front torso panel having horizontal upper and lower releasable fasteners affixed and positioned substantially at said front torso area;

said back torso panel having horizontal upper and lower releasable fasteners affixed and positioned substantially at said back torso area;

an upper left strap having a first and second end with releasable fasteners at each end, a lower left strap having a first and second end with releasable fasteners at each end, an upper right strap having a first and second end with releasable fasteners at each end and a lower right strap having a first and second end with releasable fasteners at each end wherein said releasable fasteners of each strap attach to said releasable fasteners of said front and back torso panels so as to secure said front and back torso panels about a user;

left and right D-rings affixed to said front torso panel between said upper and lower releasable fasteners and substantially at the center thereof;

left and right D-rings affixed to said back torso panel substantially at the center thereof;

an adjustable left elbow strap for encircling a user's arm below the left elbow having a D-ring affixed thereto;

an adjustable right elbow strap for encircling a user's arm below the right elbow having a D-ring affixed thereto;

a left cord restrainer having first and second ends wherein each end has a hook member affixed thereto wherein one end receives said D-ring of said left elbow strap and said other end receives said left D-ring of one of said front and back torso panels;

a right cord restrainer having first and second ends wherein each end has a hook member affixed thereto wherein one end receives said D-ring of said right elbow strap and said other end receives said right D-ring of one of said front and back torso panels;

and an arm sleeve member releasably attached to said front torso panel at the center thereof and configured to receive a left or right arm of a user.

2. The torso conforming harness of claim 1, wherein said releasable fastener of said elbow straps includes hook and loop material.

3. The torso conforming harness of claim 1, wherein said first and second cord restrainers are adjustable in length.

* * * * *